United States Patent [19]

Lee

[11] Patent Number: 4,667,923

[45] Date of Patent: May 26, 1987

[54] MOLDING DEVICE FOR MODULAR CONCRETE UNIT

[76] Inventor: Yuan H. Lee, No. 851, Chung-San Rd., Nan-Pao Tsun, Kuei-Jen, Hsian, Tainan Hsieng, Taiwan

[21] Appl. No.: 834,992

[22] Filed: Feb. 28, 1986

[51] Int. Cl.[4] ..... E04G 11/02

[52] U.S. Cl. ..... 249/19; 249/27; 249/42; 249/148; 249/152; 249/162; 249/180; 249/184; 249/193

[58] Field of Search ..... 249/20–22, 249/27, 162, 182, 184, 193, 219 R, 18, 19, 42, 144, 148, 149, 161, 177, 181, 207, 152

[56] References Cited

U.S. PATENT DOCUMENTS

| | | | |
|---|---|---|---|
| 2,544,297 | 3/1951 | Callan | 249/27 |
| 3,614,054 | 10/1971 | Beasly | 249/179 |
| 3,934,808 | 1/1976 | Aizawa | 249/27 |
| 4,519,570 | 5/1985 | Strickland et al. | 249/180 |
| 4,570,896 | 2/1986 | Strickland et al. | 249/180 |

FOREIGN PATENT DOCUMENTS 2489206 3/1982 France .

*Primary Examiner*—Jay H. Woo
*Assistant Examiner*—James C. Housel
*Attorney, Agent, or Firm*—Sughrue, Mion, Zinn, Macpeak and Seas

[57] ABSTRACT

A molding device includes a multi-sided contractible inner form and outer forms that can be connected detachably to the inner form. The inner form has, at each side, a wedge-shaped spacer formwork board, on which are mounted a power means and a linkage mechanism, disposed between and connected detachably to left and right component formwork boards. The wedge-shaped spacer boards in all sides of the inner form can be pulled inward by individual power means through individual linkage mechanisms to leave space for the left and right component formwork boards to approach one another at all sides to contract the entire inner form.

7 Claims, 14 Drawing Figures

MOLDING DEVICE FOR MODULAR CONCRETE UNIT

BACKGROUND OF THE INVENTION

This invention relates to a molding device, particularly to a molding device adapted to mold box-like modular concrete units having large assembled formwork boards that can be removed entirely from the molded concrete structure and resetted quickly at the next location.

Molding devices of the above described type have existed in various forms. U.S. Pat. No. 2,544,297 discloses an inner collapsible form having multiple plate parts interconnected at corners by means of locking devices. The inner form collapses and is released from the molded structure when the corner plate parts are unlocked. U.S. Pat. No. 3,614,054 discloses an inner form with a core frame incorporating means for collapsing and stripping the inner form from the molded structure. U.S. Pat. No. 3,934,808 discloses an inner form having side panels, end panels and corner panels. The corner panels can be pulled inward by a central single power means through a center linkage mechanism to leave a space between the adjacent side panel and end panel so that the whole inner form contracts. French Pat. No. 2489206 discloses an inner form having internal wall shutters and wedge-shaped corner pieces which can be pulled inward by individual power means. The wedge-shaped corner pieces are not connected to the shutters and move individually independently of the shutters.

SUMMARY OF THE INVENTION

The object of the present invention is to provide a molding device including a multi-sided contractible inner form and outer forms that can be connected detachably to the inner form. The inner form has, at each side, a wedge-shaped spacer formwork board, on which are mounted a power means and a linkage mechanism, disposed between and connected detachably to left and right component formwork boards. The wedge-shaped spacer boards in all sides of the inner form can be pulled inward by individual power means through individual linkage mechanisms to leave space for the approach of the left and right component formwork boards at all sides to contract the entire inner form. When each spacer board moves inward, the left and right component boards move relatively and approach one another.

Each linkage mechanism includes a lever pivoted to a corresponding spacer board and connected to a hydraulic power means mounted on the spacer board, crank members mounted at the upper and lower sides of the spacer board and connected to the lever with longitudinal links. There are upper and lower links connecting left and right component boards to the crank members.

There are detachable connecting means for the inner form and outer forms which includes top fastening means having a first top bar fixed to the top of the inner form and having a portion projecting outward, and a second top bar fixed to the top of the outer form and having a portion projecting inward. One of the top bars has a slot in the projecting portion thereof and clamping screws extending threadedly into the slot, and the other top bar has a protrusion in the projecting portion thereof to be inserted into the slot and to be clamped by the clamping screws.

The detachable connecting means further includes insert spacer members to be disposed between the inner form and the outer forms, and screw fasteners for fastening the insert spacer members to the inner form and the outer forms.

The molding device further includes a bottom form, bottom spacer members of truncated-cone shape attached detachably to the bottom form and projecting upward to be connected to and to support the inner form. There are also strut means to support the bottom form, and strut locating members to be embedded in part in the concrete floor to secure the lower end of the strut means.

The present exemplary preferred embodiment will be described in detail with reference to the following drawings, in which:

DETAILED DESCRIPTION OF THE PREFERRED EMBODIMENT

Figure 1:
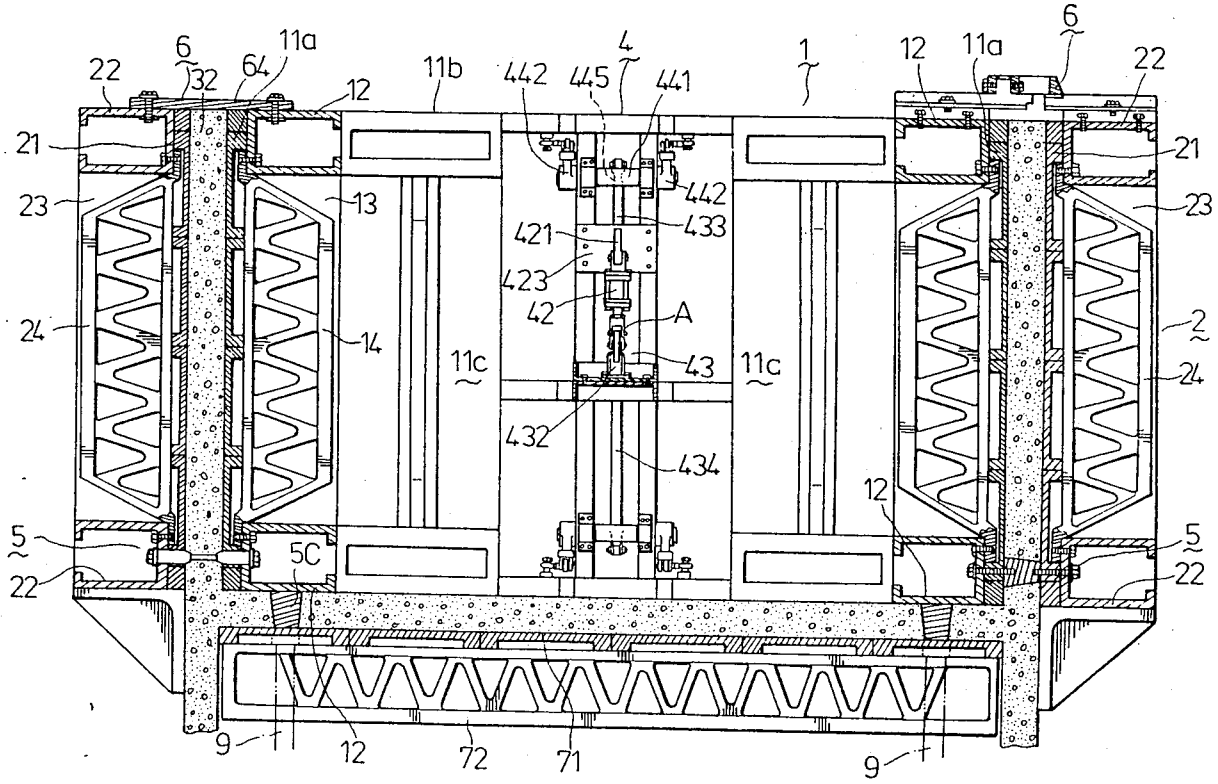
FIG. 1 is a sectional view of a molding device of the present invention having a four-sided inner form, four outer forms and a bottom form.
Figure 2:
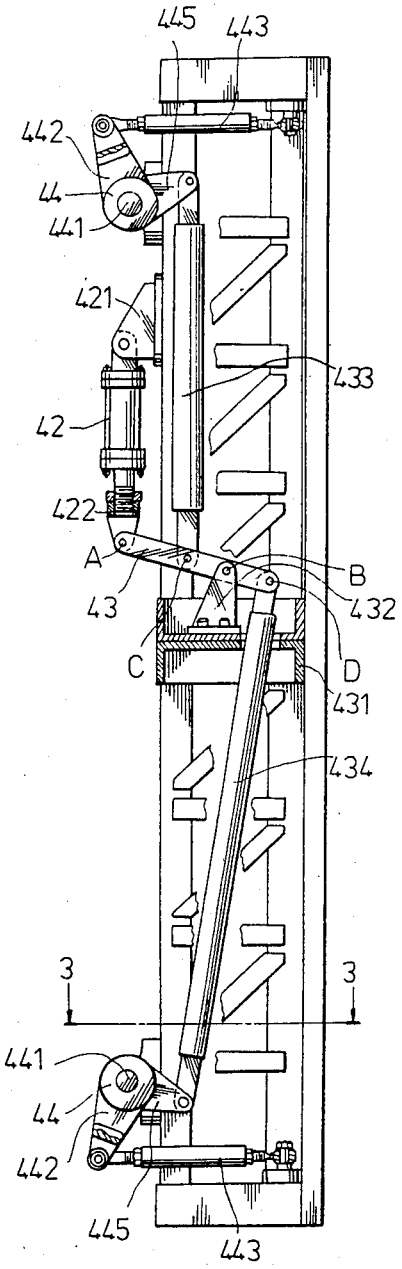
FIG. 2 is an elevation view of a wedge-shaped spacer board incorporating a power means and a linkage mechanism.
Figure 3:
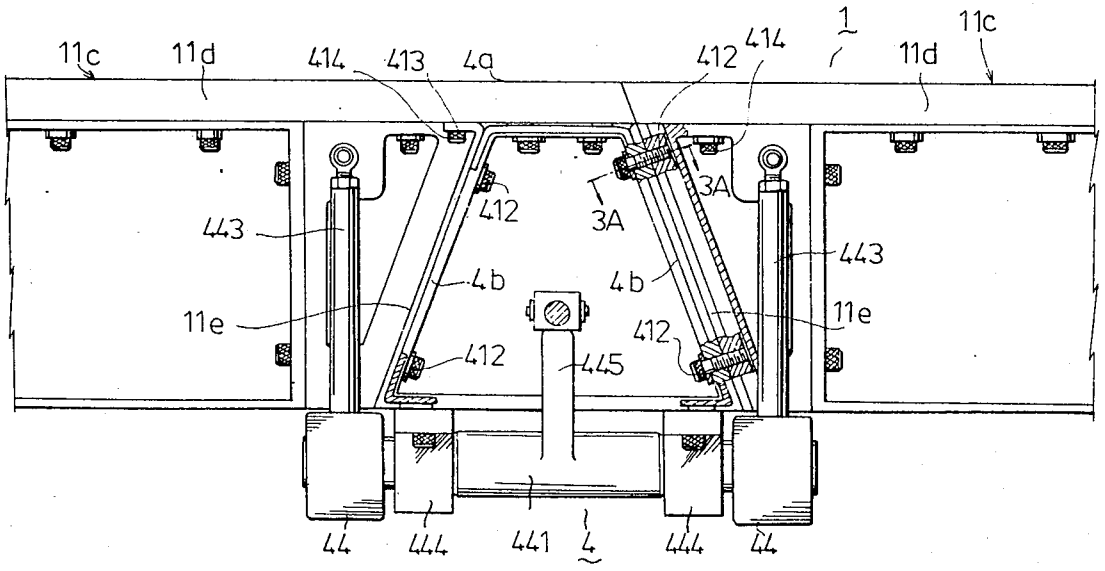
FIG. 3 is a sectional view taken along line 3—3 of FIG. 2.

Referring to FIGS. 1, 2 and 3, a molding device is shown, in its molding position, including a bottom form board 71, a four-sided inner form 1 and four outer forms 2 for molding a box-like concrete structure. The inner form 1 comprises a pair of opposing first formwork boards 11*a* and a pair of opposing second formwork boards 11*b* interconnecting said first formwork boards 11*a*. Each of the first or second formwork boards is set up by using channel members 12 and batters 13, and includes a left and right component boards 11*c* and a spacer board 4 between the left and right component boards 11*c*. Each left or right component board 11*c* has a concrete forming face 11*d*, and a web 11*e* inclining in relation to the forming face 11*d*.

The spacer board 4 has a concrete forming face 4*a* and two webs 4*b* inclining in relation to the forming face 4*a* and extending divergingly from the forming face 4*a*, forming a wedge shape in cross-section. The webs 4*b* of the spacer board 4 abut with and are secured to the webs 11*e* of the right and left component boards ll*c* by means of bolts 412.

A hydraulic cylinder 42, which is used to provide power to move each spacer board 4 inward and outward relative to left and right formwork boards 11*d*, is mounted on a bracket 421 fixed to a transverse plate 423 which is secured to the webs 4*b* of the spacer board 4. The dydraulic cylinder 42 has a piston rod 422 connected to one end A of a lever 43 which is pivoted, at point B, to a bracket 432 mounted on a fixed support member 431 below the hydraulic cylinder 42. An upper longitudinal link 433 is connected to the lever 43 at a point C and extends therefrom longitudinally upward. At the end point D of the lever 43 is connected a lower longitudinal link 434 which extends longitudinally downward therefrom. The points D and C are on two sides of the point B.

Each of links 433 and 434 is connected to crank means 44 provided at the top and bottom of the spacer board 4. Each crank means 44 has an arm 445 connected to the end of link 433 or 434 and extending from a crank shaft 441 journalled in two journal supports 444 of the spacer board 4. Two arms 442 extend from crank wheels 44 disposed at the ends of the crank shaft 441. The arms 442 are connected pivotally to two links 443 respectively which are connected pivotally to the adjacent left and right component boards 11*d*. The operation of the hydraulic cylinder and the above linkage mechanism will be described hereinafter.

Figure 3A:
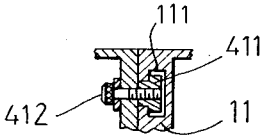
FIG. 3A is a fragmentary sectional view taken along line 3A—3A of FIG. 3.

The webs 4*b* of the spacer board 4 are connected movably to the webs 11*e* of the left and right component boards 11*d* by using bolts 412. Each bolt 412 is threaded through a screw hole of one of the webs 4*b* into a block 411 which is fitted movably in an elongated guide groove 111 provided in the web 11*e* of the left or right component board 11*d*, as shown in FIGS. 3A and 3B. The blocks 411 can move in the grooves 111 when the spacer board 4 is moved relative to the left and right component boards. Angled brackets 413 are fixed to the webs 4*b* and then screwed to the left and right component boards 11*d* to secure detachably the spacer board 4 to the left and right component boards 11*d*. In this situation, the spacer boards 4 are wedged in between the adjacent left and right component boards, and the forming faces 4*a* thereof are flush with the forming faces of the left and right component boards 11*d*. The whole inner form 1 is in a completely expanded position for molding. Each outer form board 2 is assembled using modular boards, channel members 22 and batters 23 and 24, and is secured to each side of the formwork board of the inner form 1 by securing means. The forming faces of the outer form boards are spaced apart from the forming faces of the inner form 1.

The securing means includes insert spacer members 5 incorporating screw fasteners for fastening and spacing the forming faces of the outer form 2 and the inner form 1*a*, and top fastening means 6 for hanging the outer forms 2 on the inner form 1.

Figure 4:
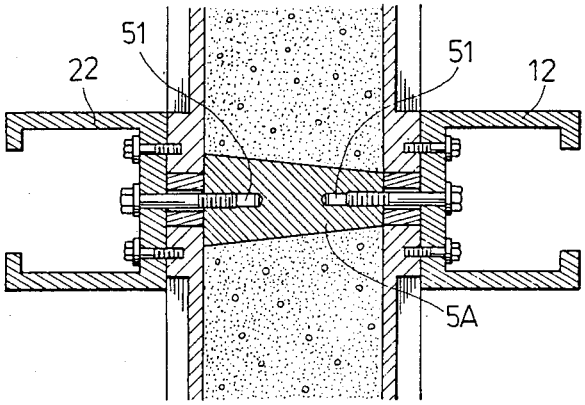
FIG. 4 is a fragmentary sectional view showing an insert spacer member disposed between the inner form and the outer form.
Figure 6:
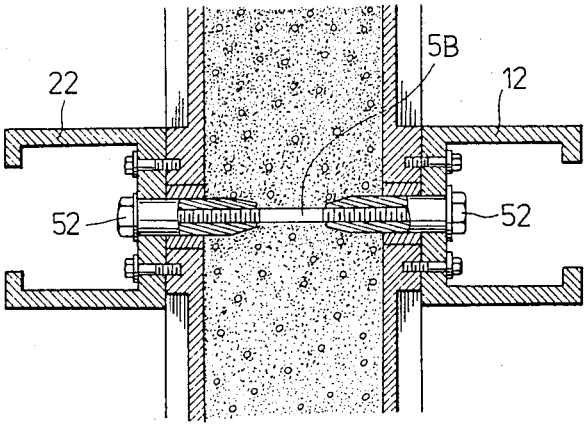
FIG. 6 is a fragmentary sectional view showing a spacer rod disposed between the inner form and the outer form.

The insert spacer members 5 can be truncated cone-shaped insert bodies 5A and/or insert rods 5B as shown in FIGS. 4 and 6. The insert spacer members 5A and 5B are disposed between the forming faces of the lower sides of the outer forms 2 and the inner form 1 and are screwed to the channel members 22 and 12 of the outer forms 2 and the inner form 1 by using bolts 51 and 52.

The truncated cone-shaped insert members 5A can be made of concrete, cast iron or the like. Each of them has two opposite threaded bores for engaging with the bolts 51 which are attached to the channel member 22 or 21. The insert rod 5B is a screw rod having two threaded ends for engaging with the bolts 52 having threaded bores.

Figure 7:
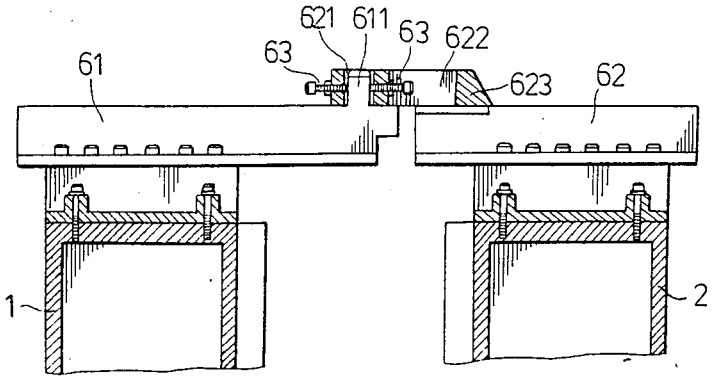
FIG. 7 is an elevation view showing a top fastening means of the molding device.
Figure 8:
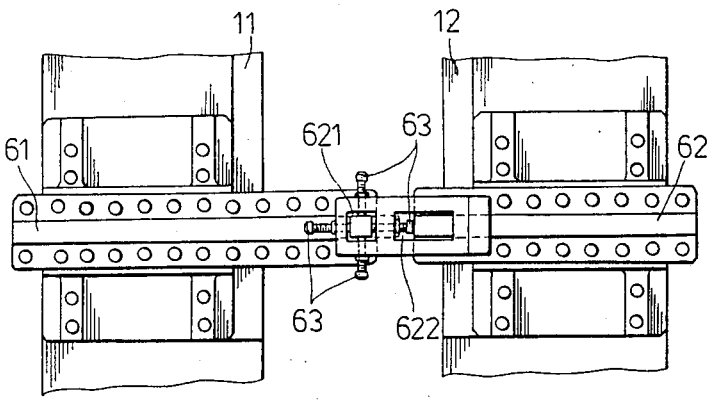
FIG. 8 is a plan view showing the top fastening means of FIG. 7.

As shown in FIGS. 7 and 8, the top fastener means 6 includes top bars 61 secured transversely to a top channel member 12 of the inner form 1 at appropriate location, and top bars 62 secured transversely to a top channel member 22 of the outer forms 2 at appropriate locations. Each of the first bars 61 has a portion projecting outward and a protrusion 611 of square cross-section at the top side of said portion. Each of the second bars 62 has a portion projecting inward and has a coupling member 623 disposed fixedly at the top side of said projecting portion. The coupling member 623 has a square slot 621 to receive the protrusion 611 and a rectangular slot 622 near the slot 621. Four clamping screws 63 are attached threadedly to the coupling member 623 and extend into the slot 621 in directions perpendicular to four sides of the slot 621 respectively. The rear portion of one of the clamping screws 63 extends in the rectangular slot 622. In assembly, the coupling member 623 of the second bar 62 is brought to overlap the projecting portion of the bar 61 so that the protrusion 611 is received in the slot 621 of the coupling member 623. Then, the protrusion 611 is clamped tightly in the slot 621 by the clamping screws 63, thereby fastening the top sides of the outer forms 2 to the top side of the inner form 1. Alternatively, the top fastener means 6 may be a fastening bar 64 which are screwed to the top side of the outer form 2 and the top side of the inner form 1 at its two ends.

Figure 5:
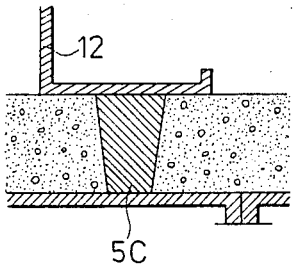
FIG. 5 is a fragmentary sectional view showing a bottom spacer member.

Referring to FIGS. 1 and 5, the bottom formwork board 71 is held by horizontal beams 72 and vertical struts (not shown). The bottom side of the whole inner form 1 is supported by and spaced apart from the top face of the bottom formwork board 71 by using spacer members 5C. The spacer members 5C are truncated cone-shaped insert bodies which are placed on and screwed to the bottom formwork board 71.

The molding device set up as described above can be used repeatedly and conveniently for casting modular concrete units. The inner form 1, outer forms 2, and bottom formwork board 71 can be detached from each other and carried to a next location without being disassembled into small units. The inner form 1 can be loosened and contracted to be released from the concrete structure by detaching the wedge-shaped spacer boards 4 from the left and right component boards 11*d* and moving them outward from between the left and right component boards 11*d* with the hydraulic means. After the inner form 1 is contracted it is lifted upward as a whole and sent to the next location. Before the inner form 1 is installed at the next location, the bottom form board 1 must be set up. Then the inner form 1 is put on the spacer insert bodies 5*c* which are attached to the bottom formwork board 71. By operating the hydraulic means, the spacer boards 4 can be moved again into between left and right component boards 11*d* to expand the whole inner form 1 tightly to the molding position.

Figure 13:
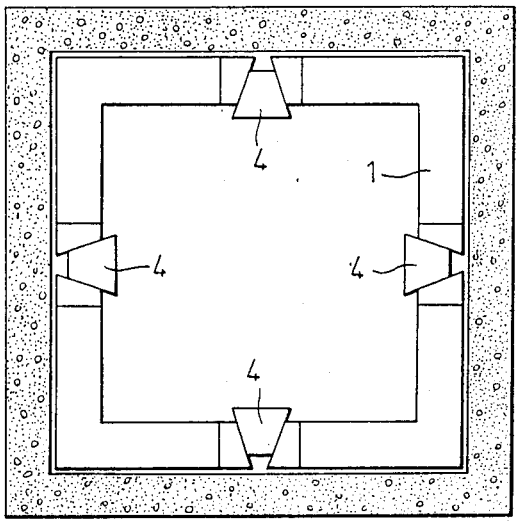
FIG. 13 is a schematic view showing the spacer boards which are moved inward relative to the left and right component boards.

Referring to FIGS. 2 and 3, when each wedge-shaped spacer boards 4 is to be pulledinward it is unfastened from the left and right component boards 11*d* by detaching screws 413. The hydraulic cylinder 42 is operated to move piston rod 422 to push the lever 43 to turn counter-clockwise about point B. In this situation, the link 433 and 434 are moved in the direction towards the mid portion of the spacer board 4 from the bottom side and the top side, thus rotating the respective crank members 44. The crank members 44, in turn, move the respective links 443 in the direction towards the forming face of the left and right component boards 11*d*, thereby moving the spacer board 4 inward. When the spacer board 4 moves inward, it causes the adjacent left and right component boards 11*d* to approach one another, thus contracting the inner form 1 and releasing it from the concrete structure, as shown in FIG. 13.

If the piston rod of each hydraulic cylinder 42 is pulled inward, the directions of the movements of the lever 43, links 433 and 434, crank members 44 and links 443 are reversed, and each spacer boards is moved again into between the adjacent left and right component boards.

Figure 9:
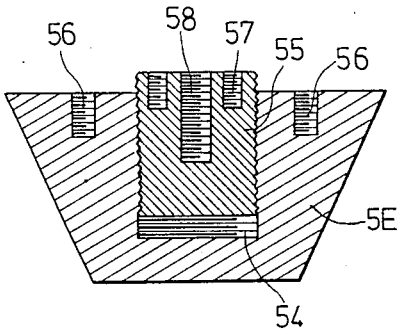
FIG. 9 is a sectional view of a strut support body.
Figure 10:
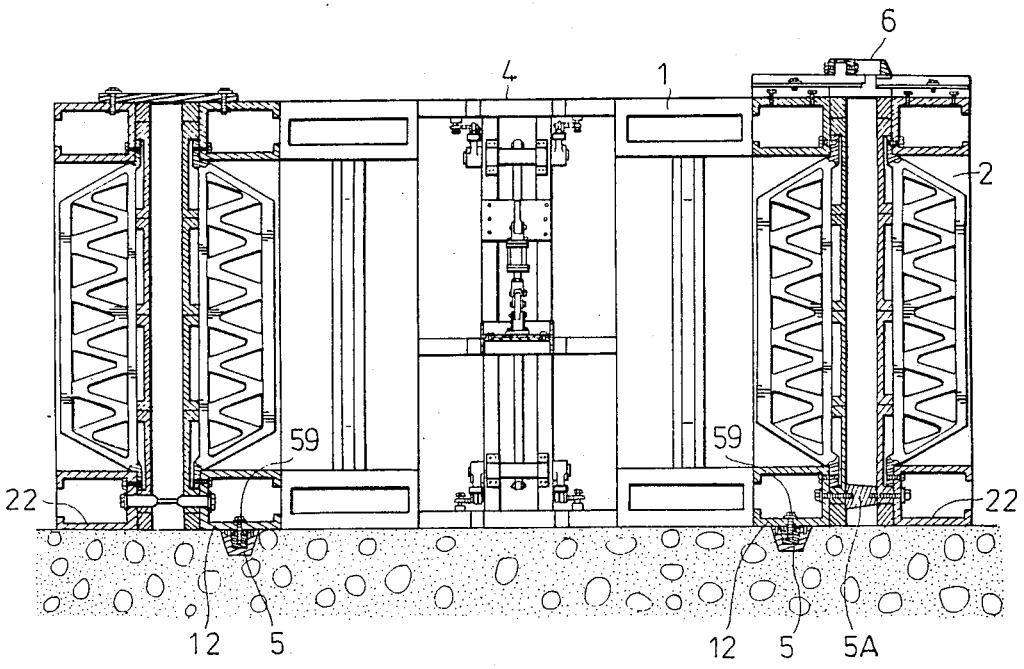
FIG. 10 is a view showing the molding device which is set up after the concrete floor is fabricated.

It is described hereinabove that the inner form 1 is supported by the bottom form board 71 by means of spacer members 5C when the concrete floor is cast simultaneously with the molding of the concrete wall. Alternatively, the inner form 1 can be set up after the concrete floor is cast. As shown in FIGS. 9 and 10, in casting the concrete floor, truncated cone-shaped support bodies 5E are concealed in part in the concrete before the concrete is hardened, the top side of the support bodies being exposed on the surface of the concrete. Each support body 5E has a threaded bore 54 and an adjustable threaded core 55 received in the bore 54. There are screw holes 56, 57 and 58 provided in the body 54 and core 55. When the concrete hardens, the support bodies 5E are secured in the concrete floor as shown. At this time, concrete walls can be fabricated by setting up the inner form 1 and outer forms 2, The channel members 12 of the inner form 1 can be connected to the support bodies 5E by inserting screws 59 into the threaded bores 58 of the core 55.

Figure 11:
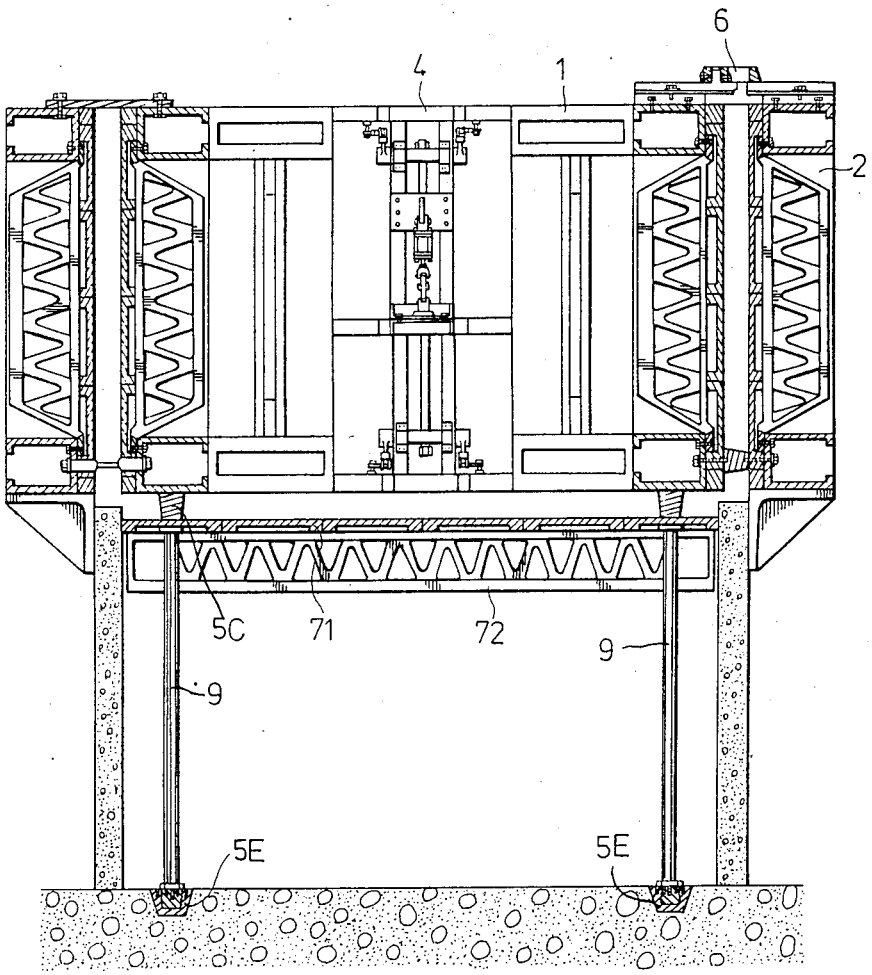
FIG. 11 is a view showing the molding device in which the inner form is support by vertical struts.

The support bodies 5E secured in a concrete floor can also be used for supporting an inner form 1 which is set up to mold the next wall structure or an bottom form 71 to mold the next concrete floor in a second floor above. As shown in FIG. 11, vertical struts 9 are set upright with their lower ends screwed to the cores 55 of the support bodies 5E. The top end of each strut 9 is screwed to the beam 72 and the bottom form board 71 for supporting the form board 71. The height of the structs can be adjusted by rotating the core 55 relative to the support body 5E.

Figure 12:
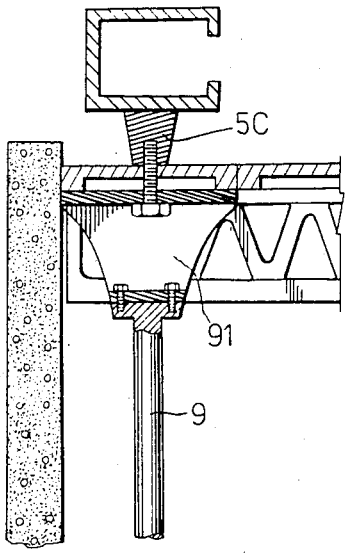
FIG. 12 is a view showing the connection between a bottom spacer member and a vertical strut.

To immobilize the insert spacer members 5C disposed on the bottom form board 71, the spacer members 5C can be screwed to hollow heads 91 of the struts 9, as shown in FIG. 12. By using vertical struts 9 and support bodies 5E, the whole weight of the inner form 1 and outer forms 2 can be bone by the completely hardened concrete of a lower floor.

Although the inner form 1 described in the present embodiment is a four-sided closed form, the present invention is not limited to four sides only. The inner form 1 can be a closed form having more or less than four sides or an open forming having three sides or more than three sides.

With the invention thus explained, it is apparent that various modifications and variations can be made without departing from the scope of the invention. It is therefore intended that the invention be limited as indicated in the appended claims.

What I claim is:

1. A molding device comprising:

an inner form having a multiplicity of sides each of which has a left component board, a right component board and a wedge-like spacer board disposed between said left and right component boards, said spacer board having a forming face and two opposing webs inclining flaredly against said forming face of said spacer board, each of said left and right component boards having a forming face and an inclined web abutting with one of said webs of said spacer board;

means for connecting movably each of said spacer boards to said left and right component boards;

means for moving each of said spacer boards forward in between said left and right component boards to expand said inner form tightly to the molding position and backward to loosen and contract said inner form so as to release it from the molded concrete, said moving means including a hydraulic power means mounted on said spacer board, a lever pivotally mounted to said spacer board and connected to said hydraulic power means, crank members mounted on upper and lower sides of said spacer board, first link members interconnecting said lever and said crank members, second link members interconnecting said crank members and said left and right component boards, and third link members interconnecting said crank members to said left and right component boards;

outer forms spaced apart from said inner form and connected to each of said sides of said inner form; and means for connecting detachably said inner form and said outer forms.

2. A molding means as claimed in claim 1, wherein said movably connecting means includes slide grooves provided in said webs of said left and right component boards and screw members attached to said webs of said spacer board and projecting into said slide grooves.

3. A molding means as claimed in claim 1, wherein said detachable connecting means includes top fastening means for fastening the top of said outer form to the top of said inner form having a top bar fixed to the top of said inner form with a portion projecting outward, and a top bar fixed to the top of said outer form with a portion projecting inward, one of said top bars having a slot in said projecting portion thereof and clamping screws extending transversely into said slot, the other one of said top bars having a protrusion in said projecting portion to be inserted into said slot and to be clamped by said clamping screws.

4. A molding device as claimed in claim 3, wherein said detachable connecting means further includes insert spacer members to be disposed between said inner form and said outer forms, a screw fasteners for fastening said insert spacer members to said inner form and said outer forms.

5. A molding device as claimed in claim 1, further comprising a bottom form, bottom insert spacer members of truncated-cone shape attached detachably to said bottom form and projecting upward to connect to and to support said inner form.

6. A molding device as claimed in claim 5, further comprising strut means to support said bottom form, and strut locating members partially embedded in a previously formed concrete floor to secure a lower end of said strut means.

7. A molding device as claimed in claim 6, wherein said strut means has a hollow head to be connected to said bottom insert spacer member.

* * * * *